US008530768B2

(12) United States Patent
Hwa

(10) Patent No.: US 8,530,768 B2
(45) Date of Patent: Sep. 10, 2013

(54) THIN ILLUMINATED KEYBOARD

(75) Inventor: Chin-Hsiu Hwa, Taipei Hsien (TW)

(73) Assignee: Zippy Technology Corp., Taipei Hsien (TW)

( * ) Notice: Subject to any disclaimer, the term of this patent is extended or adjusted under 35 U.S.C. 154(b) by 289 days.

(21) Appl. No.: 12/985,880

(22) Filed: Jan. 6, 2011

(65) Prior Publication Data

US 2011/0168538 A1 Jul. 14, 2011

(30) Foreign Application Priority Data

Jan. 8, 2010 (TW) ..... 99100329 A

(51) Int. Cl.
*H01H 9/00* (2006.01)

(52) U.S. Cl.
USPC ..... 200/310; 200/314; 362/616

(58) Field of Classification Search
USPC ..... 200/243; 362/26
See application file for complete search history.

(56) References Cited

U.S. PATENT DOCUMENTS

| | | | | |
|---|---|---|---|---|
| 6,194,677 | B1 * | 2/2001 | Li | 200/344 |
| 7,503,683 | B2 * | 3/2009 | Liu | 362/616 |
| 7,939,773 | B2 * | 5/2011 | Tsai | 200/313 |
| 8,035,048 | B2 * | 10/2011 | Ko et al. | 200/314 |
| 8,319,130 | B2 * | 11/2012 | Lee et al. | 200/314 |
| 8,338,729 | B2 * | 12/2012 | Jung et al. | 200/314 |
| 2009/0294266 | A1 * | 12/2009 | Ahlgren et al. | 200/314 |
| 2010/0243416 | A1 * | 9/2010 | Fong et al. | 200/310 |
| 2010/0246208 | A1 * | 9/2010 | Iwasaki | 362/582 |
| 2010/0271839 | A1 * | 10/2010 | Chan et al. | 362/602 |

FOREIGN PATENT DOCUMENTS

| | | |
|---|---|---|
| TW | M352718 | 3/2009 |
| TW | 200945112 | 11/2009 |
| TW | M368835 | 11/2009 |

* cited by examiner

*Primary Examiner* — Renee Luebke
*Assistant Examiner* — Ahmed Saeed
(74) *Attorney, Agent, or Firm* — Muncy, Geissler, Olds & Lowe, PLLC

(57) ABSTRACT

A thin illuminated keyboard comprises at least one keycap, an upper light guide plate and a lower light guide plate. The upper and lower light guide plates have respectively a first light guide layer and a second light guide layer opposing each other. The first and second light guide layers have respectively a first circuit layer and a second circuit layer laid on the opposing surfaces thereof. The first and second light guide layers also have respectively a first mask layer and a second reflection layer on the sides opposite to the first and second circuit layers to form an optical passage therebetween. The first mask layer has at least one light penetration zone receiving light from the optical passage. The light is transmitted and confined in the optical passage between the first and second light guide layers, and condensed to project to the keycap through the light penetration zone.

11 Claims, 5 Drawing Sheets

THIN ILLUMINATED KEYBOARD

FIELD OF THE INVENTION

The present invention relates to a thin illuminated keyboard and particularly to a thin illuminated keyboard to condense and project light to keycaps to improve illumination.

BACKGROUND OF THE INVENTION

In order to meet varying users' requirements, illuminated keyboards that integrate lighting modules to generate illumination have been developed and introduced on the market to attract consumers and provide an extra feature to increase their purchase motivation. While emphasizing the illuminated function, many producers also endeavor to reduce total thickness of the keyboard module so that it can be widely adapted to notebook computers or desktop computers highlighting thin and light design.

Conventional thin illuminated keyboards, for instance, R.O.C. patent No. M352718 discloses an illuminated keyboard which comprises a key set unit, a thin film circuit board and a lighting unit. The thin film circuit board includes a thin film bottom layer, a thin film middle layer on the thin film bottom layer and a thin film top layer on the thin film middle layer. The thin film bottom layer has a top surface with a plurality of protrusive reflective light guide points formed thereon. Light emitted from the lighting unit is reflected and scattered upwards through the light guide points. R.O.C. patent No. M368835 discloses a light guide plate for illuminated keyboards. The light guide plate includes a transparent base plate and a circuit unit laid on the top surface of the transparent base plate with conduction contacts formed thereon. The transparent base plate has a plurality of light guide points formed on the bottom surface thereof to divide the bottom surface into a plurality of light guide zones. When light projects to a lateral side of the light guide plate, it is refracted upwards through the light guide points to generate illumination.

Moreover, R.O.C. publication No. 200945112 also discloses a similar structure about a keyboard equipped with a self-illuminated circuit board. It includes a key module and a circuit board. The circuit board has at least one base plate made of a flexible light guide material and laid with circuits and a light emitting portion. The circuit board receives light from the light emitting portion and projects the light upwards to the key module.

All the aforesaid conventional techniques include a base plate made of a light guide material and laid with circuits, and the circuit board and light guide plate are integrated into a single element to shrink the thickness and size of the keyboard. However, in their keyboard modules, light is guided to project to the upper side of the keyboard through the light guide points on the circuit board or other light guide structures. Such a light guide structure makes the light scatter outside from the circuit board, and is difficult to condense the light to the area where the light is needed. Moreover, users are difficult to identify the character symbol on each keycap in such a condition. The light cannot be used effectively, hence more light emitting elements has to be installed. As a result, total power consumption increases and a greater amount of heat is generated.

SUMMARY OF THE INVENTION

The primary object of the present invention is to provide an illuminated keyboard with a thinner structure to confine light in the interior of the keyboard and project the light to preset locations to solve the problem of light scattering occurred to the conventional thin illuminated keyboards.

To achieve the foregoing object, the present invention provides a thin illuminated keyboard which comprises at least one keycap, an upper light guide plate and a lower light guide plate. The upper and lower light guide plates are located beneath the keycap, and have respectively a first light guide layer and a second light guide layer opposing each other. The first light guide layer and second light guide layer have respectively a first circuit layer and a second circuit layer laid on the opposing surfaces thereof. The first circuit layer and second circuit layer are interposed by at least one circuit switch corresponding to the keycap and triggered by depression of the keycap to generate a command signal. The first and second light guide layers also have respectively a first mask layer and a second reflection layer on the sides opposite to the first and second circuit layers. The first mask layer and second reflection layer form an optical passage between them. The first mask layer includes at least one light penetration zone receiving light from the optical passage to allow the light to project to the keycap at a preset location of the light penetration zone.

The thin illuminated keyboard of the invention thus formed provides features as follows: first, the first and second circuit layers are respectively integrated with the first light guide layer and second light guide layer, hence can significantly reduce total thickness and size of the keyboard; second, with the optical passage formed between the first mask layer and second reflection layer, light scattering can be prevented to make use of the light more effective; moreover, the light penetration zone can confine the light to be emitted in a local area of the keycap to condense light projection.

The foregoing, as well as additional objects, features and advantages of the invention will be more readily apparent from the following detailed description, which proceeds with reference to the accompanying drawings.

DETAILED DESCRIPTION OF THE PREFERRED EMBODIMENTS

Figure 1:
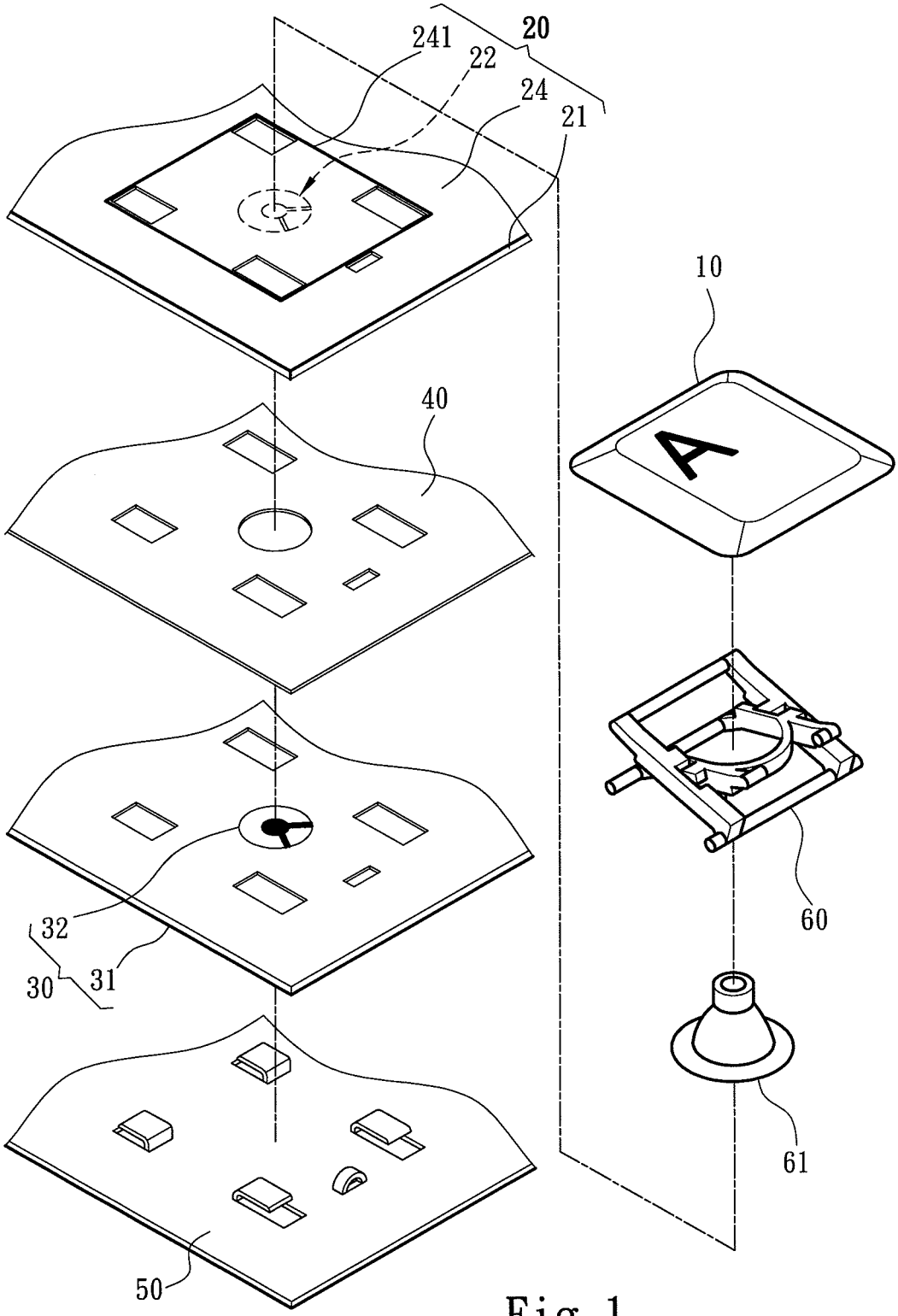
FIG. 1 is a fragmentary exploded view of a first embodiment of the thin illuminated keyboard of the invention.
Figure 2A:
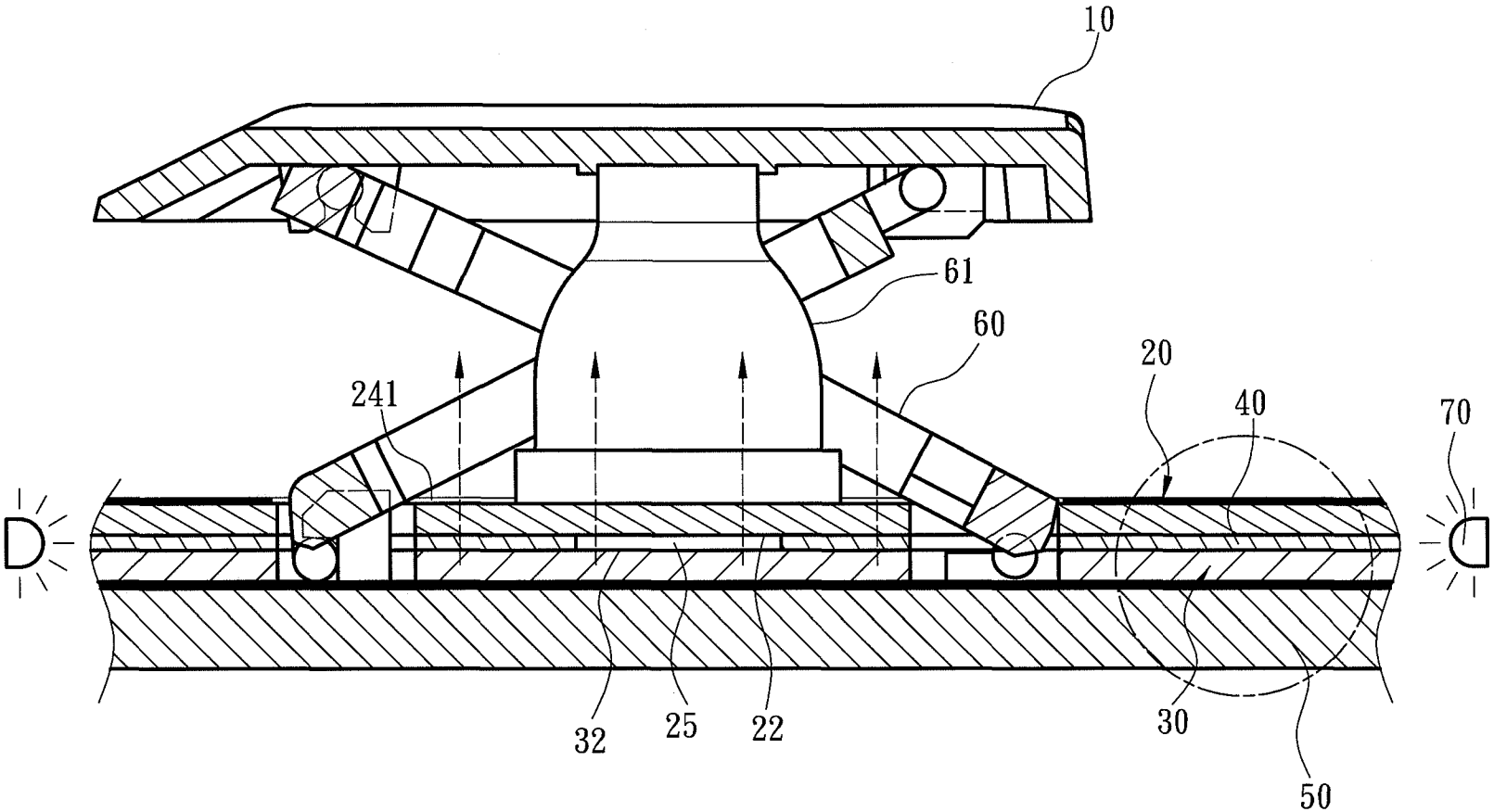
FIG. 2A is a sectional view of the first embodiment of the thin illuminated keyboard of the invention.

Please refer to FIGS. 1 and 2A for a first embodiment of the thin illuminated keyboard of the invention. It comprises a keycap 10, an upper light guide plate 20, a lower light guide plate 30 and a partition plate 40 located between the upper light guide plate 20 and lower light guide plate 30. The upper light guide plate 20 and lower light guide plate 30 have respectively a first light guide layer 21 and a second light guide layer 31 opposing each other. The first light guide layer 21, second light guide layer 31 and partition plate 40 can be made of light guide material such as poly(methyl methacrylate), polycarbonate or the like.

As shown in FIG. 1, the first light guide layer 21 and second light guide layer 31 have respectively a first circuit layer 22 and a second circuit layer 32 laid on the opposing surfaces thereof. The first circuit layer 22 and second circuit layer 32 are interposed by at least one circuit switch 25 corresponding to the keycap 10. The partition plate 40 has an opening corresponding to the circuit switch 25 to allow the first circuit layer 22 and second circuit layer 32 to contact with each other to be conducted through the opening.

The invention also has a bottom plate 50 located at the bottom of the lower light guide plate 30 and a driven mechanism 60 bridging the bottom plate 50 and keycap 10. The driven mechanism 60 includes an elastic element 61 providing a returning force for the keycap 10 so that the keycap 10 can be moved reciprocally against the bottom plate 50 when a user depresses the keycap 10. Through the aforesaid reciprocal movement of the keycap 10, the elastic element 61 presses the first circuit layer 22 to form electrical connection with the second circuit layer 32 to trigger the circuit switch 25 to generate a command signal.

Figure 2B:
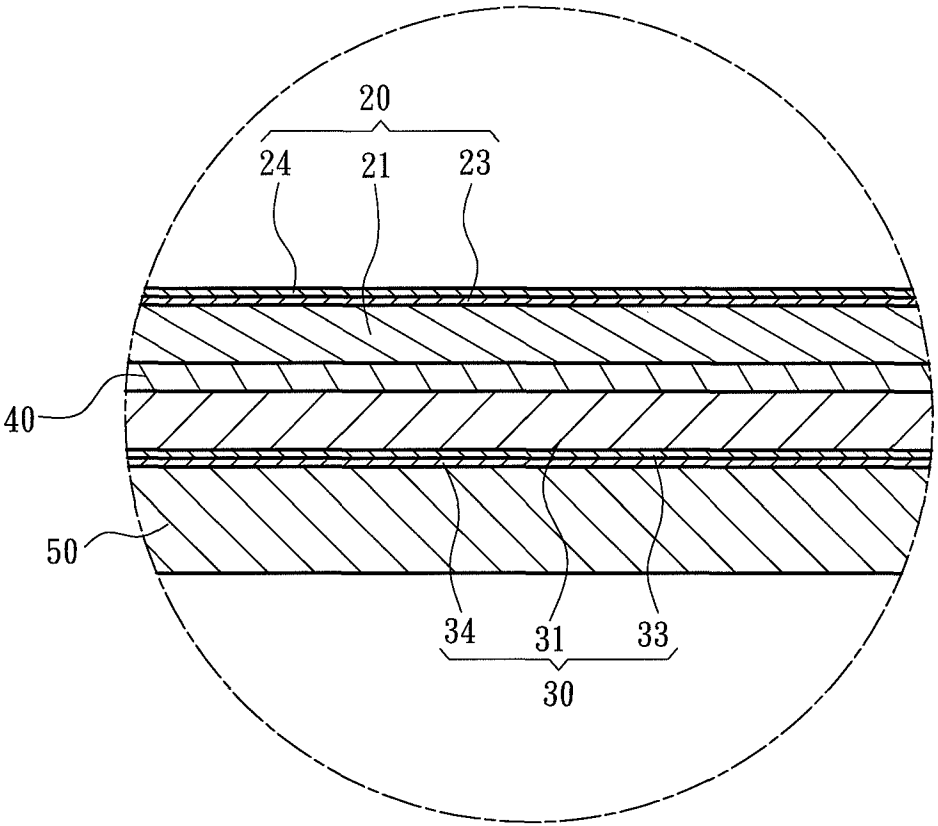
FIG. 2B is a fragmentary enlarged view of the first embodiment according to FIG. 2A.

Also referring to FIG. 2B, the first light guide layer 21 also has a first reflection layer 23 and a first mask layer 24 in this order on one side opposite to the first circuit layer 22. The second light guide layer 31 has a second reflection layer 33 and a second mask layer 34 in this order on one side opposite to the second circuit layer 32. The first mask layer 24 has at least one light penetration zone 241. The first and second reflection layers 23 and 33 can be formed by coating, such as coating reflective ink on the first and second light guide layers 21 and 31. The first and second mask layers 24 and 34 can also be formed by coating, such as coating dark-colored ink or shading ink on the first and second reflection layers 23 and 33. The areas of the first reflection layer 23 and the first mask layer 24 corresponding to the keycap 10 are not coated to form the light penetration zone 241 to allow light to pass through.

The first mask layer 24 and second reflection layer 33 form an optical passage between them so that light can transmit through the optical passage among the upper light guide plate 20, lower light guide plate 30 and partition plate 40. The second mask layer 34 also can prevent the light from passing through the second reflection layer 33 to scatter downwards. The first reflection layer 23 allows the light scattering upwards to reflect to the optical passage to enhance light usage. Thus, the light is confined among the upper light guide plate 20, lower light guide plate 30 and partition plate 40 without scattering. Meanwhile, the light penetration zone 241 receives the light from the optical passage and condenses and projects the light to the keycap 10 at a preset location of the light penetration zone 241.

Figure 3:
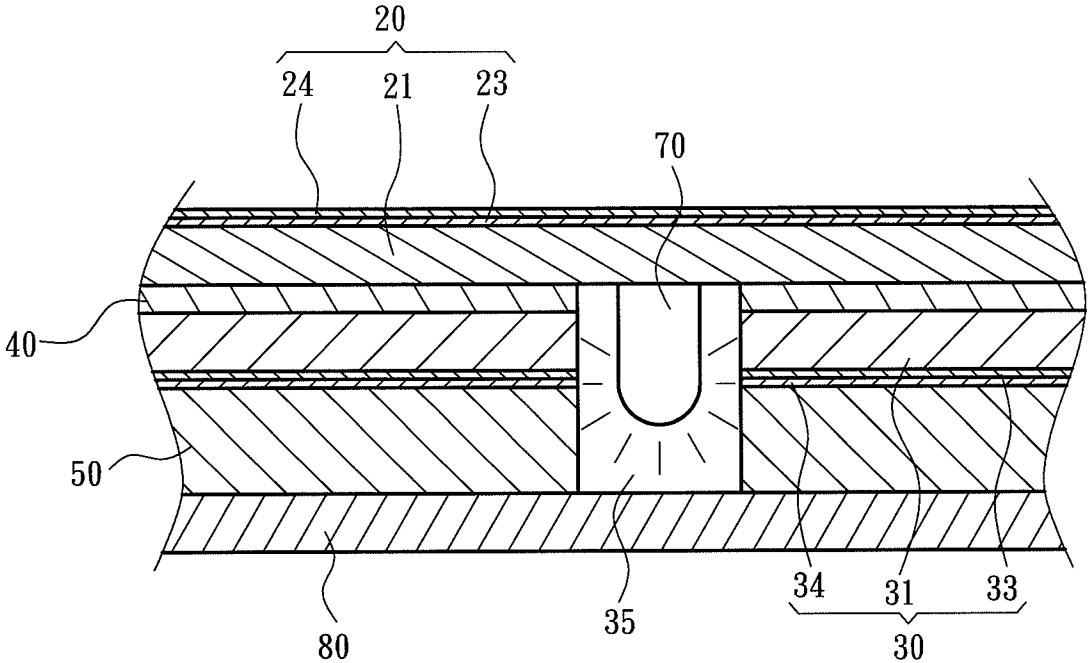
FIG. 3 is a sectional view of a second embodiment of the thin illuminated keyboard of the invention.

In the first embodiment shown in FIGS. 1 and 2A, the upper light guide plate 20, lower light guide plate 30 and partition plate 40 receive the light from a light emitting unit 70 which is located at a lateral side of the upper light guide plate 20, lower light guide plate 30 and partition plate 40 to form light transmission between them. The light emitting unit 70 can select an electroluminescent light emitting element, an LED or other light emitting element according to actual requirements. FIG. 3 depicts a second embodiment which differs from the first embodiment by forming a coaxial hole 35 passing through the partition plate 40, lower light guide plate 30 and bottom plate 50 to form a housing space between the upper light guide plate 20 and bottom plate 50. The light emitting unit 70 is fastened to the upper light guide plate 20 through surface-mount technology and held in the housing space, thereby to form optical transmission and conduction with the first light guide layer 21. In this embodiment, a reflection plate 80 is provided below the bottom plate 50 to reflect the light projecting downwards in the housing space from the light emitting unit 70 back to the first light guide layer 21, second light guide layer 31 and partition plate 40.

Figure 4:
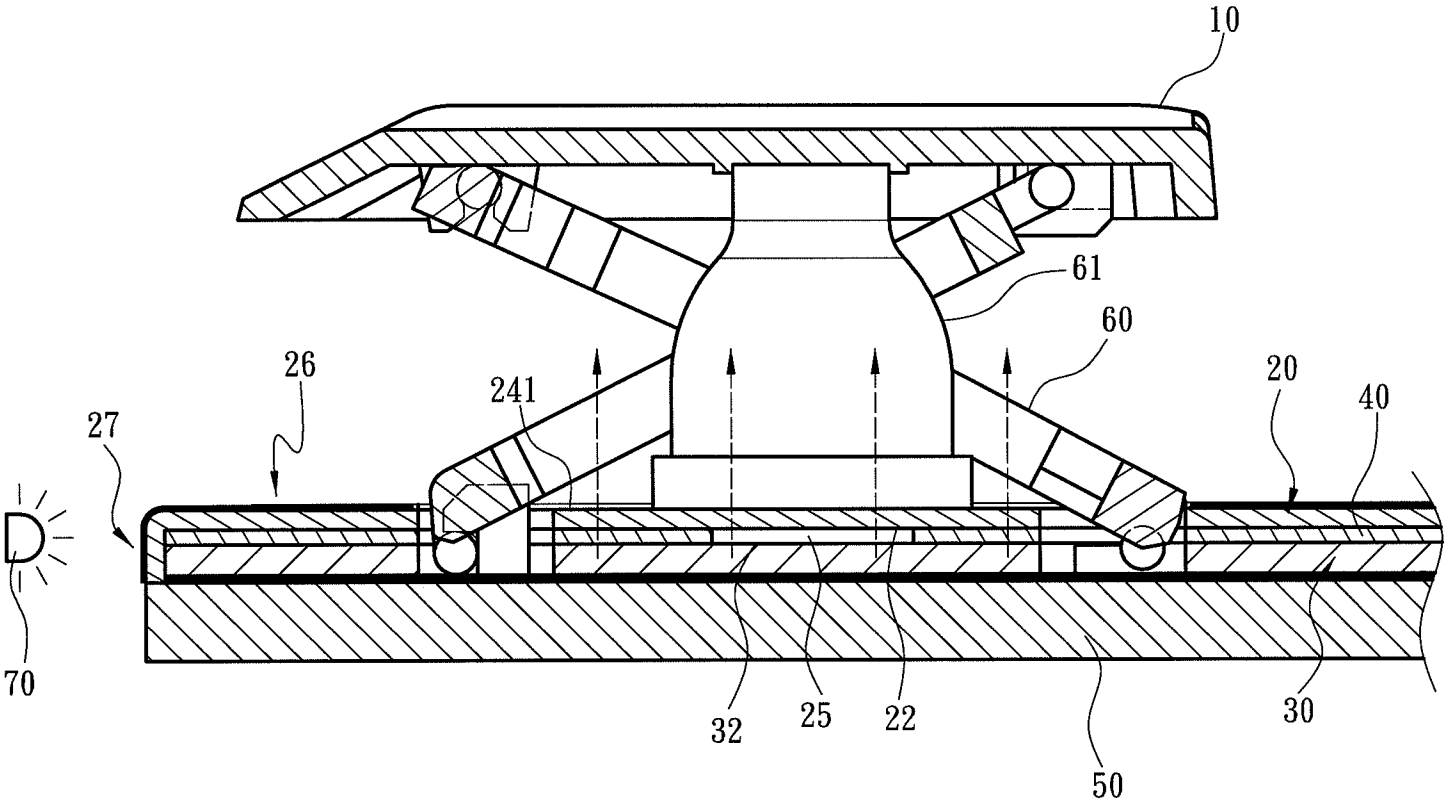
FIG. 4 is a sectional view of a third embodiment of the thin illuminated keyboard of the invention.

FIG. 4 illustrates a third embodiment in which the upper light guide plate 20 includes a top plate 26 and a lateral portion 27 that can be formed by bending the upper light guide plate 20 to a right angle. The upper light guide plate 20 and lateral portion 27 form a holding space to hold the partition plate 40 and lower light guide plate 30. In this embodiment, the lateral portion 27 is formed at one side of the top plate 26. In practice, the lateral portion 27 can be formed at two sides of the top plate 26 or at the edges thereof. Through the first mask layer 24 formed on the lateral portion 27, the light scattered from the lateral sides of the upper light guide plate 20, lower light guide plate 30 and partition plate 40 is blocked and reflected by the first reflection layer 23.

As a conclusion, the thin illuminated keyboard of the invention mainly utilizes the first and second light guide layers covered by the first and second reflection layers to reflect the light between the first and second light guide layers. Moreover, the first and second reflection layers respectively have the first and second mask layers formed thereon and an optical passage is formed between the first mask layer and second reflection layer to prevent the light from scattering through the first and second light guide layers. In addition, the light penetration zone is positioned to mate the keycap, thus the light can be condensed and project to the keycap. Furthermore, the light emitting unit is located in the housing space between the upper light guide plate and bottom plate to further shrink the total size of the keyboard. Moreover, with the first and second circuit layers integrally formed on the first and second light guide plates, no additional space is needed to hold the light guide elements and circuit elements in separate manner, hence the total structure of the thin illuminated keyboard can be made thinner and lighter. It provides a significant improvement over the conventional techniques.

While the preferred embodiments of the invention have been set forth for the purpose of disclosure, modifications of the disclosed embodiments of the invention as well as other embodiments thereof may occur to those skilled in the art. Accordingly, the appended claims are intended to cover all embodiments which do not depart from the spirit and scope of the invention.

What is claimed is:

1. A thin illuminated keyboard, comprising:

at least one keycap; and an upper light guide plate and a lower light guide plate that are located beneath the keycap and include respectively a first light guide layer and a second light guide layer opposing each other, the first light guide layer and the second light guide layer including respectively a first circuit layer and a second circuit layer laid on the opposing surfaces thereof and being interposed by at least one circuit switch corresponding to the keycap and triggered by depression of the keycap to generate a command signal, the first light guide layer and the second light guide layer also including respectively a first mask layer and a second reflection layer on the sides opposite to the first and second circuit layers;

wherein the first mask layer and the second reflection layer form an optical passage therebetween, the first mask layer including at least one light penetration zone receiving light from the optical passage and project the light to the keycap at a preset location of the light penetration zone.

2. The thin illuminated keyboard of claim 1, wherein the upper light guide plate further includes a first reflection layer located between the first mask layer and the first light guide layer.

3. The thin illuminated keyboard of claim 1, wherein the lower light guide plate further includes a second mask layer on one side of the second reflection layer opposite to the second light guide layer.

4. The thin illuminated keyboard of claim 1, wherein the upper light guide plate and the lower light guide plate are interposed by a partition plate which includes an opening corresponding to the circuit switch.

5. The thin illuminated keyboard of claim 1 further including a bottom plate located beneath the lower light guide plate.

6. The thin illuminated keyboard of claim 5, wherein the keycap and the bottom plate are bridged by at least one driven mechanism which includes an elastic element to provide a returning force for the keycap to move reciprocally against the bottom plate.

7. The thin illuminated keyboard of claim 5, wherein the lower light guide plate and the bottom plate include respectively a hole to form a housing space between the upper light guide plate and the bottom plate to hold a light emitting unit.

8. The thin illuminated keyboard of claim 7 further including a refection plate beneath the bottom plate to reflect the light emitted from the light emitting unit to the optical passage.

9. The thin illuminated keyboard of claim 7, wherein the light emitting unit is connected to the upper light guide plate to form optical conduction with the first light guide layer.

10. The thin illuminated keyboard of claim 8, wherein the light emitting unit is connected to the upper light guide plate to form optical conduction with the first light guide layer.

11. The thin illuminated keyboard of claim 1, wherein the upper light guide plate includes a top plate and a lateral portion connected to the top plate to form a holding space to hold the lower light guide plate.

* * * * *